US009132357B2

(12) United States Patent
Aamodt et al.

(10) Patent No.: US 9,132,357 B2
(45) Date of Patent: Sep. 15, 2015

(54) BELT SEAT SWING SAFETY ATTACHMENT DEVICE AND METHOD FOR USING SAME

(71) Applicants: Robert Aamodt, Peyton, CO (US); Ambyr Kirkpatrick, Peyton, CO (US)

(72) Inventors: Robert Aamodt, Peyton, CO (US); Ambyr Kirkpatrick, Peyton, CO (US)

( * ) Notice: Subject to any disclaimer, the term of this patent is extended or adjusted under 35 U.S.C. 154(b) by 0 days.

(21) Appl. No.: 14/309,669

(22) Filed: Jun. 19, 2014

(65) Prior Publication Data

US 2014/0378237 A1 Dec. 25, 2014

Related U.S. Application Data

(60) Provisional application No. 61/837,775, filed on Jun. 21, 2013.

(51) Int. Cl.

| | |
|---|---|
| ***A63G 9/12*** | (2006.01) |
| ***A63G 9/00*** | (2006.01) |
| *A47D 13/00* | (2006.01) |

(52) U.S. Cl.

CPC ..... *A63G 9/00* (2013.01)

(58) Field of Classification Search

CPC .... B60N 2/2812; B60N 2/2806; B60N 2/286; B60N 2/265; A47D 13/086; A47D 15/00; A63G 9/00; A63G 9/12

USPC ..... 472/118–125; 297/484, 485, 465, 467

See application file for complete search history.

(56) References Cited

U.S. PATENT DOCUMENTS

| | | | | |
|---|---|---|---|---|
| 2,414,698 | A | | 1/1947 | Picard |
| 3,191,932 | A | | 6/1965 | Brilz |
| 3,256,016 | A | | 6/1966 | Berlin |
| 3,713,692 | A | | 1/1973 | McCracken et al. |
| 4,382,595 | A | | 5/1983 | Tolar |
| 4,834,460 | A | | 5/1989 | Herwig |
| 4,881,780 | A | * | 11/1989 | Barnes ..... 297/467 |
| 5,334,099 | A | | 8/1994 | Marra et al. |
| 5,533,934 | A | | 7/1996 | Miller |
| 5,839,965 | A | | 11/1998 | Mullins |
| 6,095,613 | A | * | 8/2000 | Ostrander et al. ..... 297/467 |
| 7,175,535 | B1 | | 2/2007 | Marmentini |
| 7,578,746 | B1 | | 8/2009 | Johnson |
| 7,837,568 | B1 | | 11/2010 | Glaze |
| 8,382,201 | B2 | | 2/2013 | Mills |
| 2003/0040372 | A1 | | 2/2003 | McNutt et al. |
| 2006/0220437 | A1 | | 10/2006 | Merson |
| 2007/0243939 | A1 | | 10/2007 | Mead |

OTHER PUBLICATIONS

Instructions for SwingEase, from HoneyBee Child (downloaded from internet Jul. 17, 2014).

* cited by examiner

*Primary Examiner* — Kien Nguyen

(74) *Attorney, Agent, or Firm* — Marsh Fischmann & Breyfogle LLP

(57) ABSTRACT

A belt seat swing attachment device and methods for using the device to enable young children to safely utilize a belt seat swing, such as those commonly found at public playgrounds or parks. The device includes a seating portion and an attachment portion. The seating portion includes a torso band that is configured to surround a belt seat and a cradle band that hangs freely from the torso band in a U-shaped configuration. The attachment portion includes attachment straps comprising hook and loop fasteners that are configured to removably attach to a belt seat swing so that the device can be secured to the swing.

17 Claims, 7 Drawing Sheets

BELT SEAT SWING SAFETY ATTACHMENT DEVICE AND METHOD FOR USING SAME

CROSS-REFERENCE TO RELATED APPLICATIONS

This application claims priority to U.S. Provisional Application No. 61/837,775, filed on Jun. 21, 2013 and entitled Child Swing Trainer, the entire disclosure of which is incorporated herein by reference in its entirety.

FIELD

This disclosure relates to the field of swings, such as swings that are commonly found at parks and playgrounds, and in particular relates to a device for attachment to a swing that facilitates the use of the swing by a small child.

BACKGROUND

Many public parks and playgrounds feature swings whereby a user (e.g., a child) can sit in a seat and swing back and forth for amusement. Many such swings are so-called belt seat swings that comprise a flexible seating surface, usually made of rubber or a similar material, as these swings are durable and have few moving parts that can break or degrade.

However, belt seat swings are not appropriate (e.g., not safe) for smaller children who do not yet have the coordination or physical size to safely balance in the belt seat. It would be beneficial to have a device that could easily attach to a swing, particularly a belt seat swing, to enable smaller children to safely use the swing.

SUMMARY

Accordingly, the present disclosure relates to a device that is configured to attach to a conventional swing seat that is commonly found at parks and playgrounds (e.g., a belt seat swing) to provide an encompassing swing seat enclosure. The device enables a conventional belt seat swing to be rapidly and easily converted into a swing seat that can be used for training children who may not feel comfortable using a conventional belt seat swing by adding vertical and lateral support for the child. The user may transform a conventional belt seat swing into a swing that is usable by a small child by sliding the device over the conventional belt seat then securing it to the mounting hardware associated with the belt seat, e.g., that attaches the belt seat to the chain. The device has the ability to adapt to various conventional swing seats and child size. The device allows a child to sit on the conventional swing seat while providing additional support around their waist, between their legs and under their backside to help prevent them from sliding off the seat itself.

Thus, in one embodiment, a belt seat swing attachment device is provided. The device comprises a seating portion and an attachment portion that is configured to secure the seating portion to the belt seat swing. The seating portion includes a torso band in the form of a closed loop and defining an upper opening. A cradle band has a first end affixed to the torso band at a front portion of the torso band and a second end affixed to a rear portion of the torso band. A central portion of the cradle band between the first and second ends projects downwardly from the upper opening and hangs freely from the torso band in a U-shaped configuration. The attachment portion includes a first attachment strap affixed to a right side portion of the torso band and a second attachment strap affixed to a left side portion of the torso band, wherein the first and second attachment straps comprise hook and loop fasteners that are configured to removably attach to a belt seat swing.

The foregoing embodiment of a belt seat swing attachment device may have certain features that provide additional advantages. In one characterization, the torso band is a substantially continuous closed loop of pliable webbing. In another characterization, the upper opening (e.g., the torso band) has a circumference of at least about 30 inches to receive a small child placed through the opening, and not greater than about 38 inches to ensure that the child is adequately restrained and supported by the torso band.

In another characterization, the cradle band comprises a length of pliable webbing, e.g., of polypropylene. In another characterization, the cradle band is affixed to the torso band by stitching, e.g., by stitching the ends of the cradle band to the torso band. In another characterization, the torso band has a width that is greater than the width of the cradle band. In another characterization, the seating portion consists essentially of the torso band and the cradle band and specifically does not include additional bands extending downwardly away from the opening, that are orthogonally disposed to the cradle band.

In another configuration, the attachment portion further includes a third attachment strap affixed to the right side portion of the torso band proximate the first attachment strap, and a fourth attachment strap affixed to the left side portion of the torso band adjacent the second attachment strap. The additional attachment straps may advantageously improve the stability of the seating portion in the belt seat swing.

In use, the conventional belt seat swing is slid through the torso band (e.g., through the upper opening) and the seating portion is raised until the central portion of the cradle band (e.g., the upper surface of the central portion) comes into contact with the belt seat (e.g., with a lower surface of the belt seat). As a result, the opposite ends of the belt seat are brought together by the torso band to secure the child with respect to lateral movement. The seat portion is then securely attached to the belt seat swing, such as by passing the hook and loop fasteners through a closed metal loop that is attached to the belt seat.

DETAILED DESCRIPTION

Figure 1:
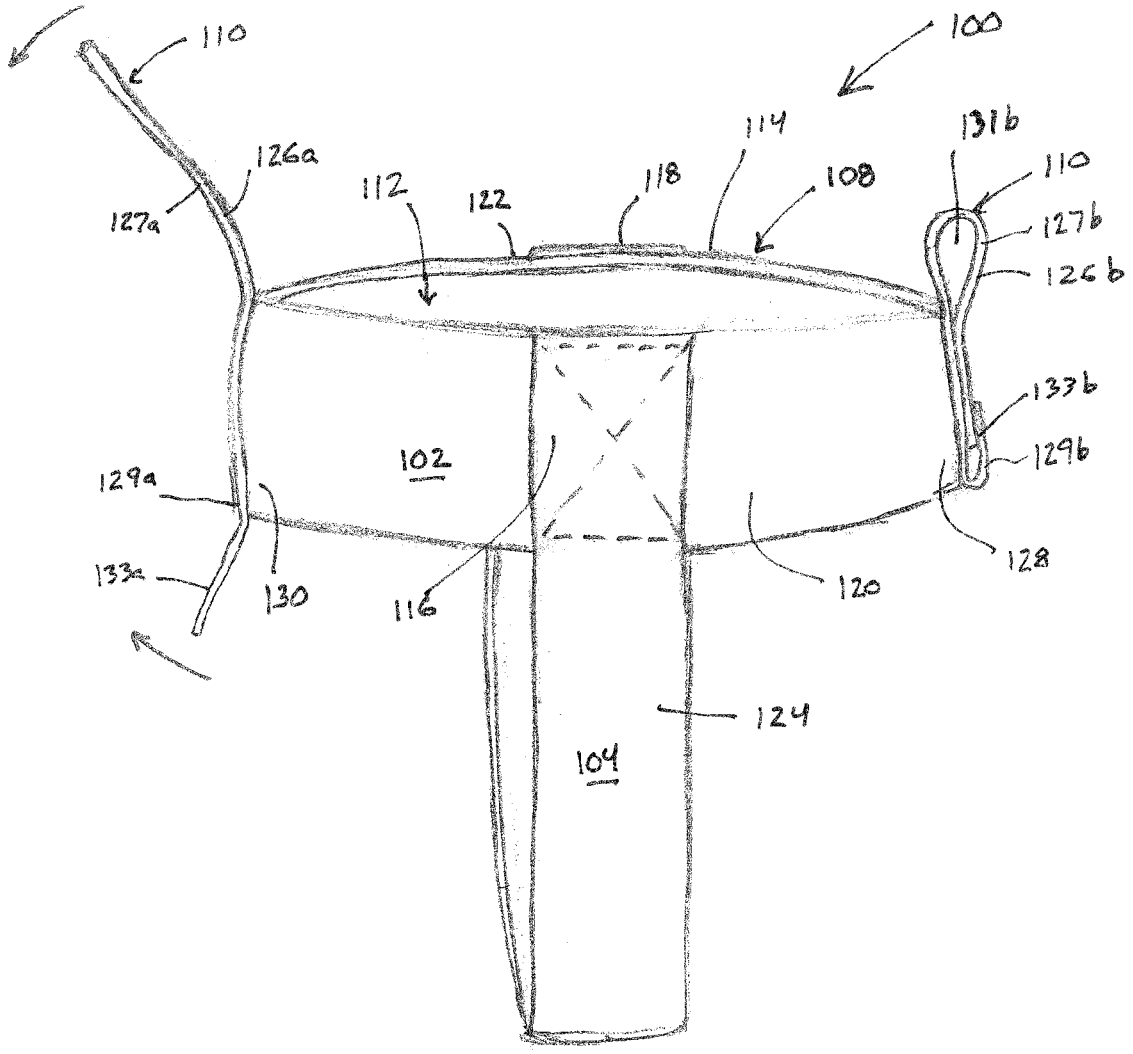
FIG. 1 illustrates a front view of a belt seat swing attachment device according to the present disclosure.
Figure 2:
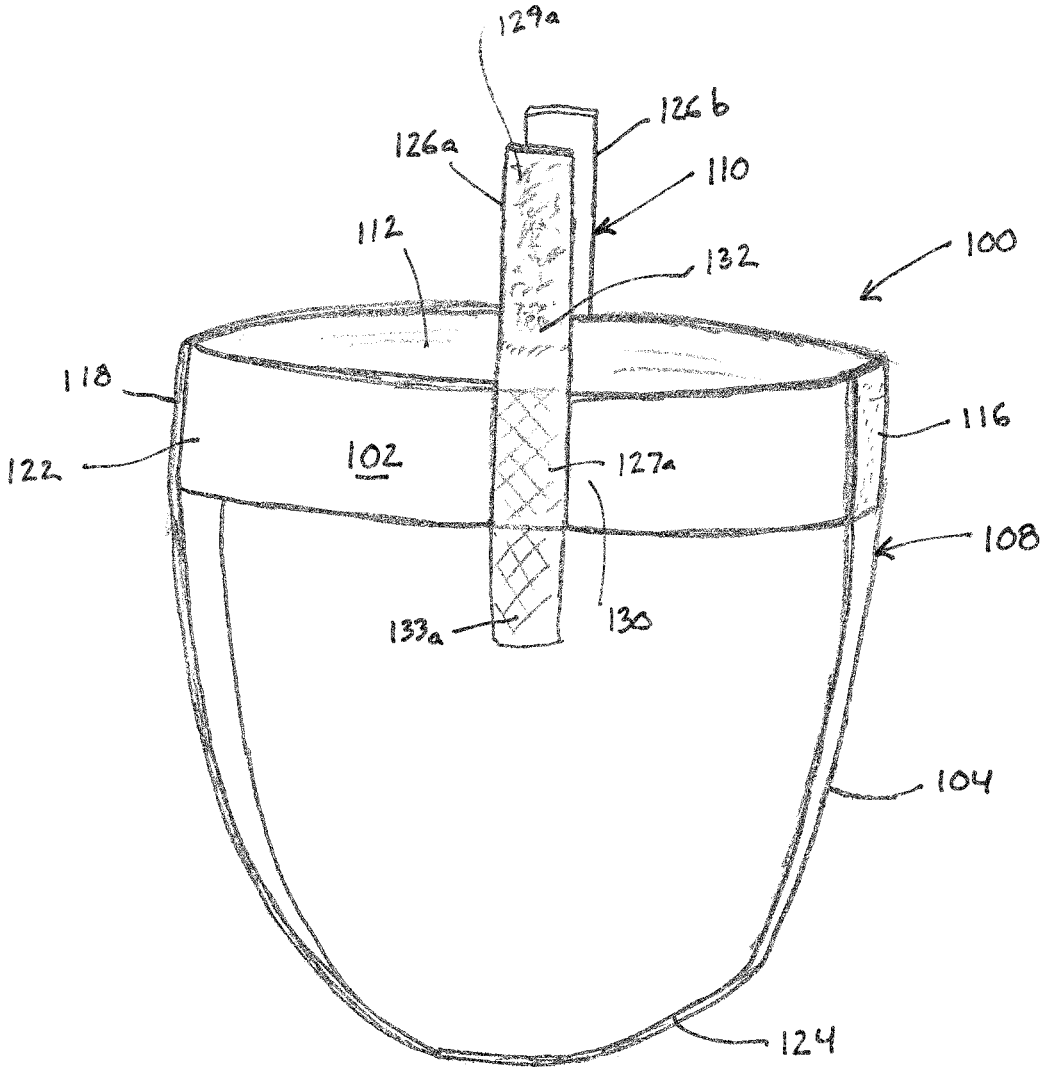
FIG. 2 illustrates a side view of the belt seat swing attachment device illustrated in FIG. 1.
Figure 3:
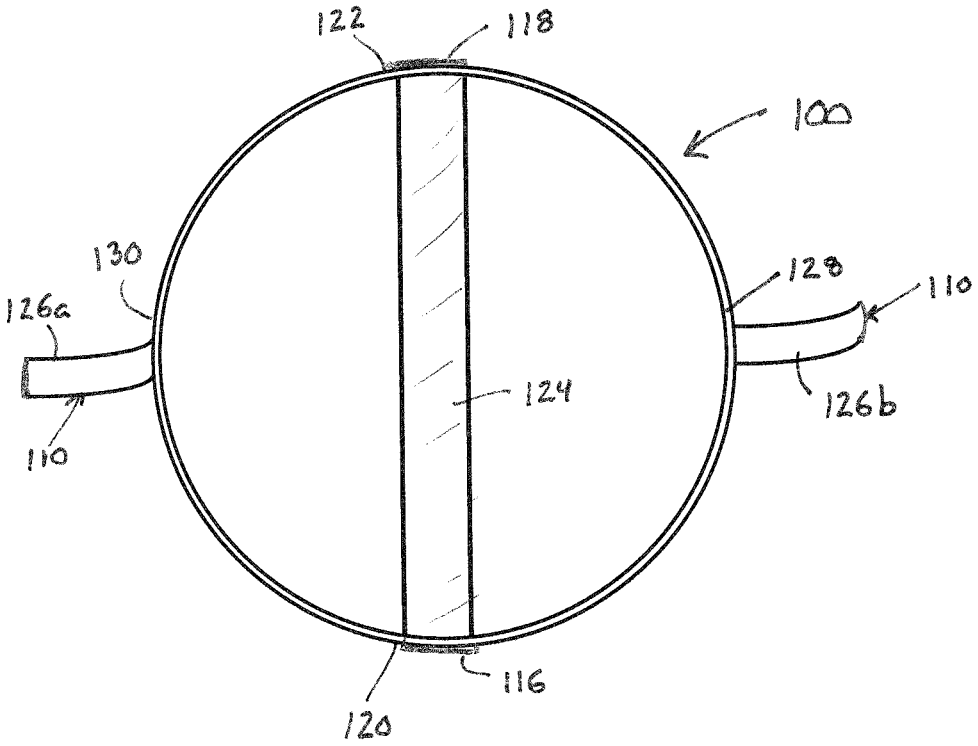
FIG. 3 illustrates a top view of the belt seat swing attachment device illustrated in FIG. 1.

FIGS. 1 to 3 illustrate various views of a belt seat swing attachment device 100 in accordance with one embodiment of the present disclosure. The attachment device 100 includes a seating portion 108 that is configured to operatively wrap around a belt seat swing so that a small child may be secured by the seating portion 108, and an attachment portion 110 that is configured to removably and securely attach the seating portion 108 to the belt seat swing.

The seating portion 108 includes a torso band 102 and a cradle band 104 that is affixed to the torso band 102. In use, the torso band 102 is laterally disposed to secure the child placed in the seating portion 108 from excessive lateral movement, e.g., lateral movement that would cause the child to fall from the swing or that would otherwise make the child feel unsecure. Although the torso band may include a buckle to attach opposite ends of the torso band together, the torso band 102 illustrated in FIGS. 1-3 forms a closed loop 114 (e.g., an uninterrupted loop) to secure the child in the swing. The use of buckles and other similar devices may create a safety issue if the buckle is not adequately fastened by the user, who may themselves be a child, e.g., an older sibling. Further, buckles, snaps and similar means of attachment create "pinch points" where the small child may pinch their skin, such as while trying to enter or exit the device.

The torso band 102 may have a width (e.g., in the vertical direction) that is sufficient to safely and comfortably secure the child in the swing. In this regard, the torso band 102 may have a width of at least about 3 inches and not greater than about 5 inches. The torso band 102 may comprise webbing fabricated from an elastic (e.g., stretchable) material, from a static (e.g., substantially non-stretchable) material, or from a combination of elastic and static materials. Useful materials can include woven or non-woven materials, such as natural fibers (e.g., cotton), leather, polymers such as polypropylene or other plastics, nylon and the like. In one particular embodiment, the torso band 102 is fabricated from polypropylene webbing.

The cradle band 104 includes a first end 116 and a second end 118. Each of the ends 116 and 118 is affixed (e.g., permanently) to the torso band 102. Specifically, the first end 116 of the cradle band 104 is affixed to a front portion 120 of the torso band 102 and the second end 118 (e.g., opposite the first end 116) is affixed to a rear portion 122 of torso band 102. The central portion 124 of the cradle band 104 thus projects downwardly from the torso band 102 (e.g., from the upper opening 112) and hangs freely from the torso band 102 in a generally U-shaped configuration, as illustrated in FIG. 2. As illustrated in FIGS. 1-3, the seating portion 108 includes a single cradle band 104, e.g., the seating portion 108 of FIGS. 1-3 may be characterized as consisting essentially of a torso band 102 and a single cradle band 104 affixed to the front portion 120 and rear portion 122 of the torso band 102.

In the embodiment illustrated in FIGS. 1-3, the cradle band 104 has a width (e.g., in the lateral direction) that is less than the width of the torso band 102. In one characterization, the cradle band 104 has a width that is at least about 2 inches and is not greater than about 3 inches. The cradle band 104 may be fabricated from the materials listed above with respect to the torso band 102, and in one characterization the torso band 102 and the cradle band 104 are fabricated from same material, e.g., from polypropylene webbing.

The belt seat swing attachment device 100 also includes an attachment portion 110 that is configured to securely attach the device 100 to a conventional belt seat swing, e.g., to secure the seating portion 108 to the belt seat swing. In the embodiment illustrated in FIGS. 1-3, the attachment portion 110 includes a first attachment strap 126*a* and a second attachment strap 126*b*. The first attachment strap 126*a* is affixed (e.g., permanently) to a left side portion 130 of the torso band 102 and the second attachment strap 126*b* is affixed (e.g., permanently) to a right side portion 130 of the torso band 102. Characterized in another way, the first and second attachment straps 126*a*/126*b* are affixed to the torso band 102 and spaced apart by about 180° around a circumference of the torso band 102 when the torso band 102 is placed in a circular configuration, as in FIG. 3. The attachment straps 126*a*/126*b* may be permanently affixed to the torso band 102 by sewing, for example.

In one characterization, the attachment straps 126*a*/126*b* include hook and loop fasteners 132 (e.g., VELCRO brand fasteners) that are configured to loop around the belt seat swing to secure the device 100 to the swing. Although illustrated as being affixed in an orthogonal manner to the torso band 102, the attachment straps 126*a*/126*b* may also be affixed at other angles relative to the torso band 102. As illustrated in FIGS. 1-3, the attachment straps 126*a*/126*b* include an upper portion 127*a*/127*b* that extends upwardly away from the torso band 102, and a lower portion 129*a*/129*b* that is affixed to the torso band 102 and that also includes a tail portion 133*a*/133*b* that extends downwardly away from the torso band 102. The upper portion 127*a*/127*b* may include one portion of the hook and loop fasteners on both sides of the upper portion 127*a*/127*b*. In this manner, and as illustrated in FIG. 1, to secure the device 100 to a swing, the upper portion 127*a*/127*b* may be looped around a piece of hardware on the swing (discussed in more detail below), e.g. to form loop 131*b*, and attached to a section of the lower portion 129*a*/129*b* that is affixed to the torso band 102 by virtue of hook and loop fastener material on an outer surface of the lower portion 129*a*/129*b*. The tail portion 133*a*/133*b* may then be attached to the outer surface of the top portion 127*a*/127*b* for further security and safety.

Figure 4:
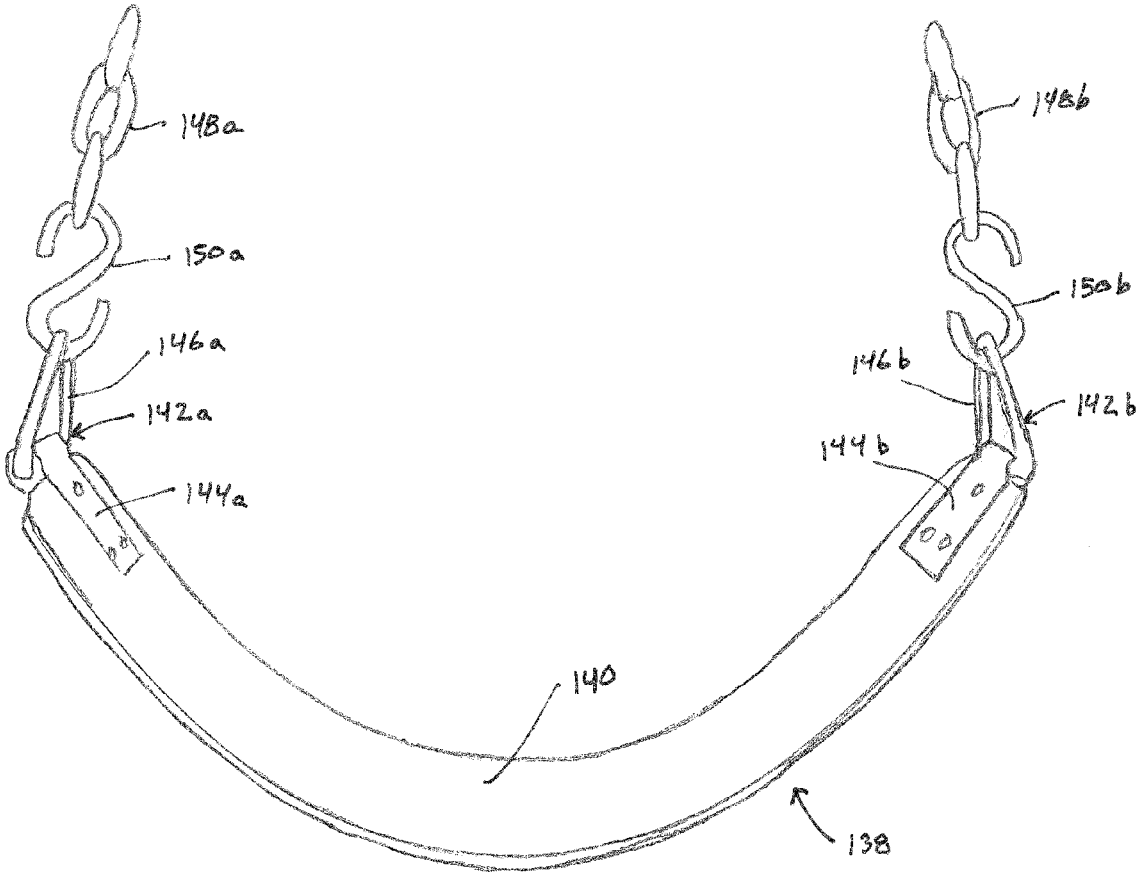
FIG. 4 illustrates a conventional belt seat swing.

For purposes of illustrating the device and methods of the present disclosure, FIG. 4 illustrates a perspective view of a conventional belt seat swing 138, such as may be commonly found at public parks and playgrounds. The swing 138 includes a belt seat 140 that is flexible and is typically fabricated from rubber or a similar material. The belt seat 140 is supported at opposite ends thereof by chains 148*a*/148*b* that are attached to a support bar (not illustrated). The seat 140 is affixed to the chains 148*a*/148*b* using mounting hardware 142*a*/142*b* that is permanently affixed to the seat 140. Typically, the mounting hardware 142*a*/142*b* includes brackets 144*a*/144*b* (e.g., metal brackets) that are affixed to the seat 140 such as by using rivets. The brackets 144*a*/144*b* extend beyond the distal edges of the seat 140 and a closed loop fastener 146*a*/146*b* (e.g., a closed metal loop) is secured to the bracket. The closed loop fastener 146*a*/146*b* thus provides a means to attach each end of the seat 140 to the chains 148*a*/148*b*, either directly or through the use of an S-loop fastener 150*a*/150*b*, for example. It will be appreciated that the flexible belt seat 140 does not provide lateral support for a user and therefore requires a user to hold onto the chains to stay in the seat 140 during use.

Figure 5:
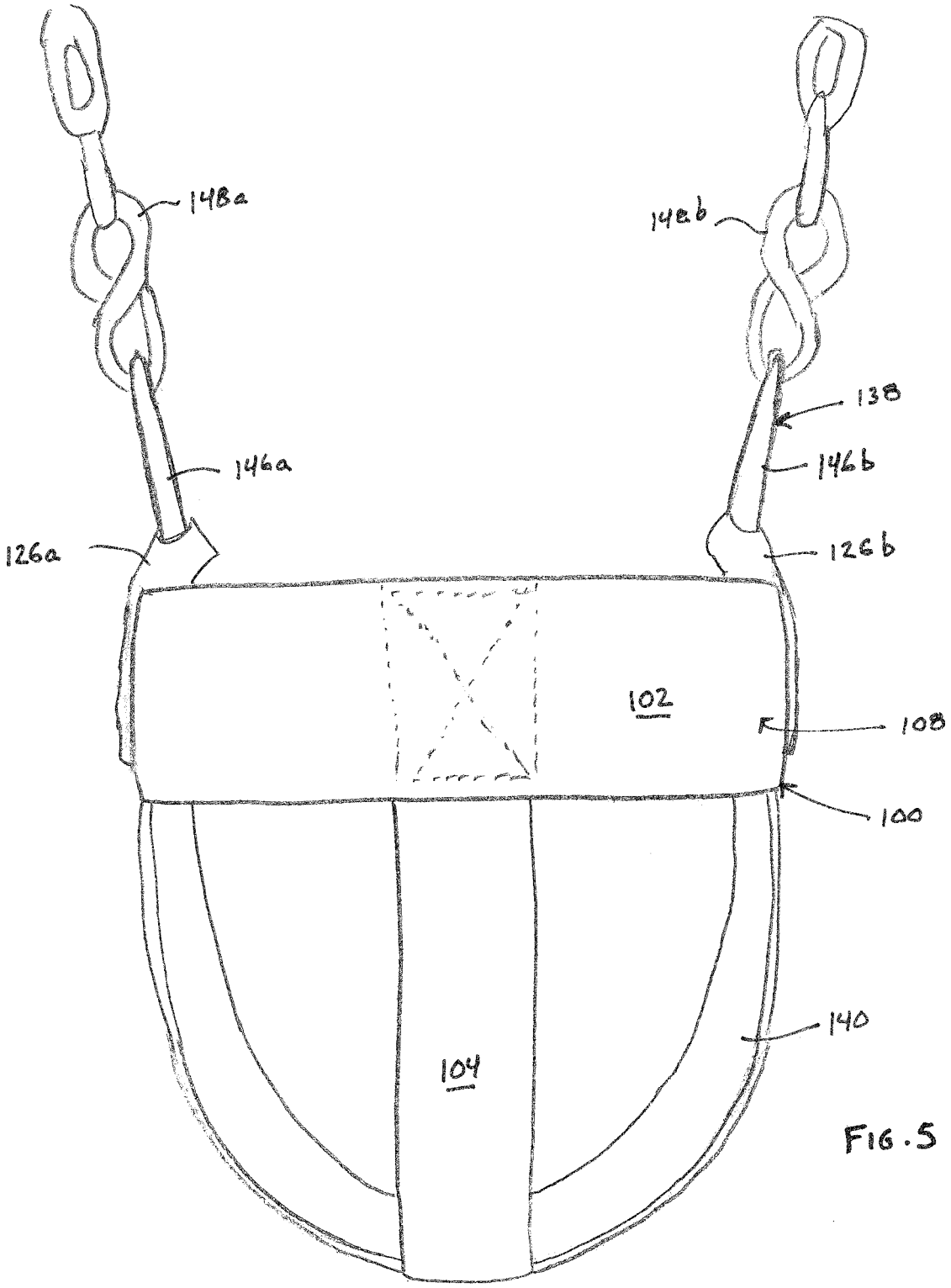
FIG. 5 illustrates the belt seat swing attachment device illustrated in FIG. 1 attached to the conventional belt seat swing illustrated in FIG. 5.

FIG. 5 illustrates a belt seat swing attachment device 100 that is attached to a belt seat swing 138, e.g., in combination with a belt seat swing 138. The device 100 has been attached to the belt seat swing by placing the belt seat 140 through the upper opening 112 (FIGS. 1-3) of the torso band 102. The seating portion 108 is then moved upward relative to the belt seat 140 until the cradle band 104 makes contact with a bottom surface of the belt seat 140. As is shown in FIG. 5, the torso band 102 causes the opposite ends of the belt seat to come together such that the seat 140 forms a U-shaped configuration to secure the child from movement in the left-right lateral direction. The cradle band 104 engages with the bottom surface of the belt seat 140 and, with the torso band 102, inhibits movement of the child in the front-rearward directions while swinging.

The seating portion 108 is attached to the belt seat swing 138 by the attachment portion 110, namely by attachment straps 126*a*/126*b*. The attachment straps 126*a*/126*b* are hook and loop fastener straps that are placed through the closed loops 146*a*/146*b* to secure the seating portion 108 to the belt seat swing 138.

Figure 6:
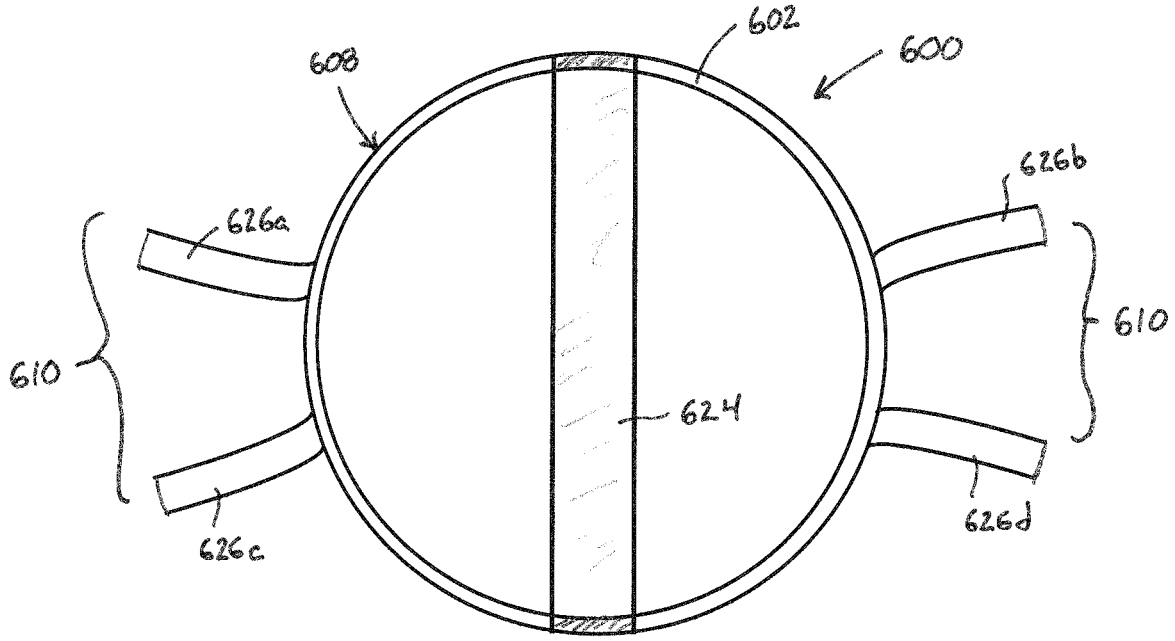
FIG. 6 illustrates a top view of an alternative embodiment of a belt seat swing attachment device.

One alternative embodiment of a belt seat swing attachment device is illustrated in FIG. 6. Specifically, FIG. 6 illustrates a top view (e.g., similar to FIG. 3) of a device 600 having a seating portion 608 and an attachment portion 610. In the embodiment illustrated in FIG. 6, the attachment portion 610 includes a total of four attachment straps, namely a first attachment strap 626*a* and a third attachment strap 626*c* affixed to the left side of the torso band 602 and a second attachment strap 626*b* and fourth attachment strap 626*d* affixed to the right side of the torso band 602. In this manner, the stability of the seating portion 608 in the belt seat swing can be improved, particularly when the attachment straps (e.g., hook and loop fasteners) are attached to a closed loop hardware element of the belt seat swing. See FIG. 5.

Figure 7:
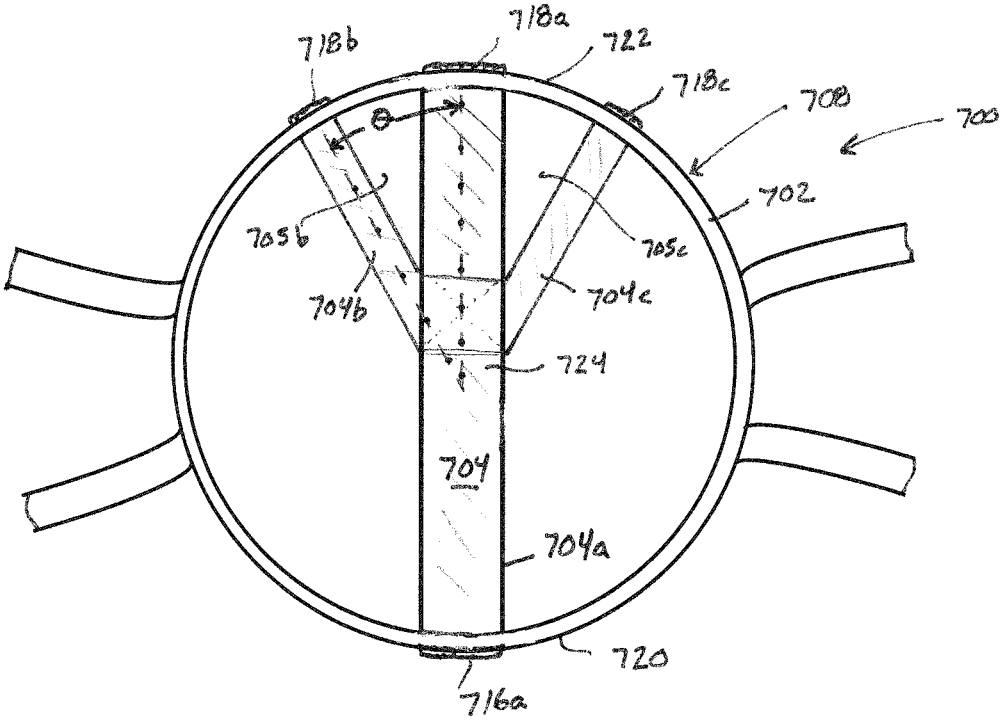
FIG. 7 illustrates a top view of another alternative embodiment of a belt seat swing attachment device.

Another alternative embodiment of a belt seat swing attachment device is illustrated in FIG. 7. Specifically, FIG. 7 illustrates a top view (e.g., similar to FIG. 3) of a device 700 having a seating portion 708. In this embodiment, the cradle band 704 of the seating portion 708 includes a primary cradle band portion 704*a* substantially as described above, e.g., with respect to FIGS. 1-3. extending from a first end 716 of the cradle band 704 that is affixed to the front portion 720 of the torso band. The primary cradle band portion 704*a* extends rearwardly, and the second end 716*a* is affixed to the rear portion 722 of the torso band 702.

The cradle band 704 of the embodiment illustrated in FIG. 7 includes two rearward cradle band portions 704*b* and 704*c*, defining a gaps 705*b* and 705*c* between the rearward portions 704*b*/704*c* and the primary cradle band 704*a*. The rearward portions 704*b*/704*c* form an angle (Θ) with the primary cradle band 704*a* of at least about 5°, such as at least about 10° to provide additional support for the child. In this regard, the angle Θ should be less than 90°, such as less than 75°, less than 60°, or even 45° or less to adequately support a small child's backside. The rearward cradle band portions 704*b* and 704*c* are affixed to a rear portion 722 of the torso band 702 in spaced-apart relation, e.g., with the primary cradle band 704*a* disposed therebetween. With this construction, the cradle band 704 may provide improved stability for a child that is seated in the seating portion 708.

While various embodiments of a belt seat swing attachment device and methods for using the device have been described in detail, it is apparent that modifications and adaptations of those embodiments will occur to those skilled in the art. However, is to be expressly understood that such modifications and adaptations are within the spirit and scope of the present disclosure.

What is claimed is:

1. A belt seat swing attachment device, comprising:
- a seating portion, the seating portion comprising:
  - a torso band in the form of a closed loop and defining an upper opening; and
  - a cradle band, the cradle band comprising:
    - a primary cradle band portion having a first end affixed to the torso band at a front portion of the torso band and a second end affixed to a rear portion of the torso band; and
    - at least first and second rearward cradle band portions extending from a central portion of the primary cradle band at an angle with respect to the primary cradle band, and affixed to a rear portion of the torso band, wherein the first and second rearward band portions are spaced-apart at the torso band to define a gap between the primary cradle band and each of the rearward cradle band portions, and
- an attachment portion, the attachment portion comprising:
  - a first attachment strap affixed to a right side portion of the torso band; and
  - a second attachment strap affixed to a left side portion of the torso band,
- wherein the first and second attachment straps comprise hook and loop fasteners that are configured to removably attach to a belt seat swing.

2. The device of claim 1, wherein the torso band comprises a substantially continuous closed loop of pliable webbing.

3. The device of claim 2, wherein the upper opening has a circumference of at least about 30 inches and not greater than about 38 inches.

4. The device of claim 1, wherein the cradle band comprises a length of pliable webbing.

5. The device of claim 4, wherein the cradle band is affixed to the torso band by stitching.

6. The device of claim 1, wherein the torso band has a width that is greater than the width of the cradle band.

7. The device of claim 1, wherein the seating portion consists essentially of the torso band and the cradle band.

8. The device of claim 1, wherein the attachment portion further comprises:
- a third attachment strap affixed to the right side portion of the torso band proximate the first attachment strap; and
- a fourth attachment strap affixed to the left side portion of the torso band proximate the second attachment strap.

9. The device of claim 1, wherein the angle is at least about 5° and is not greater than about 60°.

10. In combination, a belt seat swing and a belt seat swing attachment device, comprising:
- a belt seat swing comprising a belt seat having first and second ends operatively attached to a chain; and
- a belt seat swing attachment device secured to the belt seat swing and comprising:
  - a seating portion, the seating portion comprising:
    - a torso band in the form of a closed loop and defining an upper opening, wherein the torso band is disposed around the belt seat in a manner that causes the first end and second end of the belt seat to come together; and
    - a cradle band having a first end affixed to the torso band at a front portion of the torso band and a second end affixed to a rear portion of the torso band, wherein a central portion of the cradle band between the first and second ends projects downwardly from the upper opening and hangs freely from the torso band in a U-shaped configuration, and
  - an attachment portion, the attachment portion comprising:
    - a first attachment strap affixed to a right side portion of the torso band; and
    - a second attachment strap affixed to a left side portion of the torso band,
  - wherein the first and second attachment straps comprise hook and loop fasteners that are removably attached to the belt seat swing to secure the device to the belt seat swing.

11. The combination of a belt seat swing and a belt seat swing attachment device of claim 10, wherein the cradle band contacts bottom surface of the belt seat.

12. The combination of a belt seat swing and a belt seat swing attachment device of claim 10, wherein the cradle band comprises:

a primary cradle band portion having a first end affixed to the torso band at a front portion of the torso band and a second end affixed to a rear portion of the torso band; and at least first and second rearward cradle band portions extending from a central portion of the primary cradle band at an angle with respect to the primary cradle band, and affixed to a rear portion of the torso band, wherein the first and second rearward band portions are spaced-apart at the torso band to define a gap between the primary cradle band and each of the rearward cradle band portions.

13. A method for attaching a belt seat swing attachment device to a belt seat swing comprising a belt seat having first and second ends operatively attached to first and second chains, the method comprising:

positioning the belt seat swing attachment device under the belt seat, wherein the belt seat swing attachment device comprises:

a seating portion, the seating portion comprising;

a torso band in the form of a closed loop and defining an upper opening; and a cradle band having a first end affixed to the torso band at a front portion of the torso band and a second end affixed to a rear portion of the torso band, wherein a central portion of the cradle band between the first and second ends projects downwardly from the upper opening and hangs freely from the torso band in a U-shaped configuration; and an attachment portion, the attachment portion comprising:

a first attachment strap affixed to a right side portion of the torso band; and a second attachment strap affixed to a left side portion of the torso band, wherein the first and second attachment straps comprise hook and loop fasteners;

placing the belt seat within the upper opening of the torso band;

moving the seating portion upward relative to the belt seat causing the first and second ends of the belt seat to come together such that the belt seat forms a U-shape; and securing the first and second attachment straps to the belt seat swing causing the seating portion to be operatively secured to the belt seat swing.

14. The method as recited in claim 13, wherein the step of moving the seating portion upward comprises moving the seating portion upward relative to the belt seat until the cradle band makes contact with the bottom surface of the belt seat.

15. The method as recited in claim 13, wherein the cradle band comprises:

a primary cradle band portion having a first end affixed to the torso band at a front portion of the torso band and a second end affixed to a rear portion of the torso band; and at least first and second rearward cradle band portions extending from a central portion of the primary cradle band at an angle with respect to the primary cradle band, and affixed to a rear portion of the torso band, wherein the first and second rearward band portions are spaced-apart at the torso band to define a gap between the primary cradle band and each of the rearward cradle band portions.

16. The method recited in claim 13, wherein:

the attachment portion further comprises:

a third attachment strap affixed to the right side portion of the torso band proximate the first attachment strap; and a fourth attachment strap affixed to the left side portion of the torso band proximate the second attachment strap; and the method further comprises the steps of securing the third and fourth attachment straps to the belt seat swing.

17. The method recited in claim 16, wherein the belt seat swing comprises first and second closed loop hardware elements operatively attaching the seat belt to the first and second chains, and wherein the steps of securing the first and second attachment straps and the third and fourth attachment straps to the belt seat swing comprise securing the first and third attachment straps to the first closed loop hardware element and securing the third and fourth attachment straps to the second closed loop hardware element.

* * * * *